US006029923A

United States Patent [19]

Ishimaru et al.

[11] Patent Number: 6,029,923

[45] Date of Patent: Feb. 29, 2000

[54] MAGNETIC NONCONTACTING TENSION DEVICE FOR WINDING YARN

[75] Inventors: Takashi Ishimaru; Yasuo Yokoyama; Toshiaki Akashi, all of Kiryu, Japan

[73] Assignee: Ogura Clutch Co., Ltd., Japan

[21] Appl. No.: 09/162,847

[22] Filed: Sep. 29, 1998

[30] Foreign Application Priority Data

| | | | |
|---|---|---|---|
| Jan. 1, 1997 | [JP] | Japan | 9-284399 |
| Oct. 1, 1997 | [JP] | Japan | 9-284403 |
| Feb. 2, 1998 | [JP] | Japan | 10-035455 |
| Feb. 2, 1998 | [JP] | Japan | 10-035456 |

[51] Int. Cl.[7] ..... B65H 59/16

[52] U.S. Cl. ..... 242/366; 242/366.2; 242/419.9

[58] Field of Search ..... 242/365.6, 365.7, 242/366, 364.9, 365, 419.5, 419.9, 419.3, 366.2, 155 R, 155 M

[56] References Cited

U.S. PATENT DOCUMENTS

| | | | |
|---|---|---|---|
| 2,705,362 | 4/1955 | Roughsedge . | |
| 3,034,744 | 5/1962 | Bancroft . | |
| 3,294,328 | 12/1966 | Schmidt et al. | 242/365.6 |
| 3,924,818 | 12/1975 | Pfeifle | 242/365 |
| 4,102,509 | 7/1978 | Paepke | 242/366.2 |
| 4,399,952 | 8/1983 | Schaub | 242/366 |
| 4,660,783 | 4/1987 | Roser et al. | 242/366 |
| 5,454,151 | 10/1995 | Bogucki-Land | 242/365.7 |
| 5,791,584 | 8/1998 | Kuroiwa | 242/419.3 |

*Primary Examiner*—John M. Jillions

*Attorney, Agent, or Firm*—Bliss McGlynn, P.C.

[57] ABSTRACT

A tension device for winding yarn includes a bracket with an inclined face and a braking member accommodated in the bracket. A rotary shaft protrudes from the center of the bracket. A tubular member has a through-hole for the rotary shaft. A forward guide member includes two hub members mounted on the axial end of the rotary shaft with a yarn winding portion joining the hub members.

9 Claims, 8 Drawing Sheets

MAGNETIC NONCONTACTING TENSION DEVICE FOR WINDING YARN

BACKGROUND OF THE INVENTION

This invention relates to a tensioner or tensioning device for fiber machines, such as a warping machine. More particularly, this invention relates to a magnetic non-contacting tension device for winding yarn.

Tensioning devices that are conventionally used in fiber machinery have a braking device that operates on the running of yarns such as thread, spun yarn, twisted yarn, and the like. Such devices include an advancement guiding member that is installed on the rotary shaft of the braking device and onto which yarn is helically wound. A tenser includes a pair of tenser-discs between which the yarn is sandwiched on the opposing working surfaces of the discs which have a bulged-out plate shape. A passage for yarn is formed so that the yarn passes from the inlet guide, tenser and advancement guiding member to the outlet guide. The tensioner is formed into a unit which is assembled onto a bracket.

In a conventional tensioner, a yarn advance guiding member or pulley is installed onto the shaft end of the rotary shaft of the braking device. The shaft protrudes from the insertion hole for a tubular member that stands on the bracket. The advance guiding member is supported rotatably on the tubular member via a bearing. Therefore, when yarn chips, and debris, enter from the opening of the insertion hole for the tubular member, the rotary shaft is braked by the friction force of sliding on such debris. As a result, a tension force larger than a set braking force is added to the yarn and breaking of the yarn occurs during its running. The objective of this invention is to solve such a problem and to offer a tensioner that can add a set tension to the yarn for a long period.

Additionally, in a conventional tension device, wound-up yarn can slacken and come off from the advance guiding member because of the inertial rotation of the advance guiding member when the yarn stops running. Also, when the yarn is rerun in this condition, it catches on the members that form the yarn path and it can be cut. On the other hand, a conventional tension device adds only a main tension, due to the brake force of the brake device to the yarn. The supplemental tension of the tenser is not needed. The general purpose properties of such conventional tension devices are poor. The objective of this invention is to offer a tension device that prevents the cutting of yarn because of slackening of the yarn caused by the inertial rotation of the advance guiding member, and to improve the general purpose properties of such tension device.

SUMMARY OF THE INVENTION

To achieve the said objective, the tension device of the invention has a bracket (2) having a side for a running face for yarn filaments. The bracket has an inclined surface (2*b*) at a set angle add an annular concave or recessed portion (4) formed in the inclined surface (2*b*) on the side of a forward guiding member (9 or 30). The bracket (2) has an accommodating portion or storage part (2*d*) formed inside the concave part (4). A brake device (7) is accommodated or stored in the storage part (2*d*). A rotary shaft (8) that projects from the bottom center of the recessed portion or concave part (4). A tubular member (6) has a support part (6*b*) that is eccentric to a through hole (6*a*) for the rotary shaft (8) and tilted at the same angle as the inclined surface (2*b*). The tubular member stands at the bottom center of the concave portion (4). A first hub member (9*a*, 30*a*) is attached on the shaft end of the rotary shaft (8) that projects from the tube member (6). A second hub member (9*b*, 30*b*) is fitted to the concave portion (4) and has a surface that is opposite to the first hub member (9*a*, 30*a*). The hub members are placed on the same plane as the inclined surface (2*b*) at the opening of the concave portion (4) and are supported rotatably on the support part (6*b*). An advance guiding member (9, 30) having a wrap-around part (9*c*, 30*c*) connects these hub members (9*a*, 9*b* or 30*a*, 30*b*).

A support shaft (25) extends from the center of the bottom of a second recessed portion (5). A tenser (24) with lower tenser disc (24*b*) of bulged-out round-plate shape is freely fitted to the support shaft (25) and has a bulged-out part that fits to the second recessed or concave portion (5). Upper tenser disc (24*a*) of bulged-out round-plate shape is freely fitted to the support shaft (25) and is placed on a lower tenser disc (24*b*). A press-down member (26) is provided that presses down the upper tenser disc (24*a*) onto the lower tenser disc (24*b*).

In addition, the tension device has a tenser holder (27), of which one end is connected to support shaft (25) of tenser (24) and the other end is extended over the tenser (24) to the non-yarn path part of bracket (2) provided to the tension device on the side of the running surface of bracket (2). The tenser (24) is retreated from the yarn path by being guided by the tenser holder (27).

The tension device has multiple weights (26) freely fitted to tenser holder (27) as the press-down member (26) for tenser (24). Supplemental tension is applied to the yarn that runs between the mutually opposing working surfaces of the upper terser disc (24*a*) and lower tenser disc (24*b*) by these weights (26).

DETAILED DESCRIPTION OF THE DRAWINGS

Figure 1:
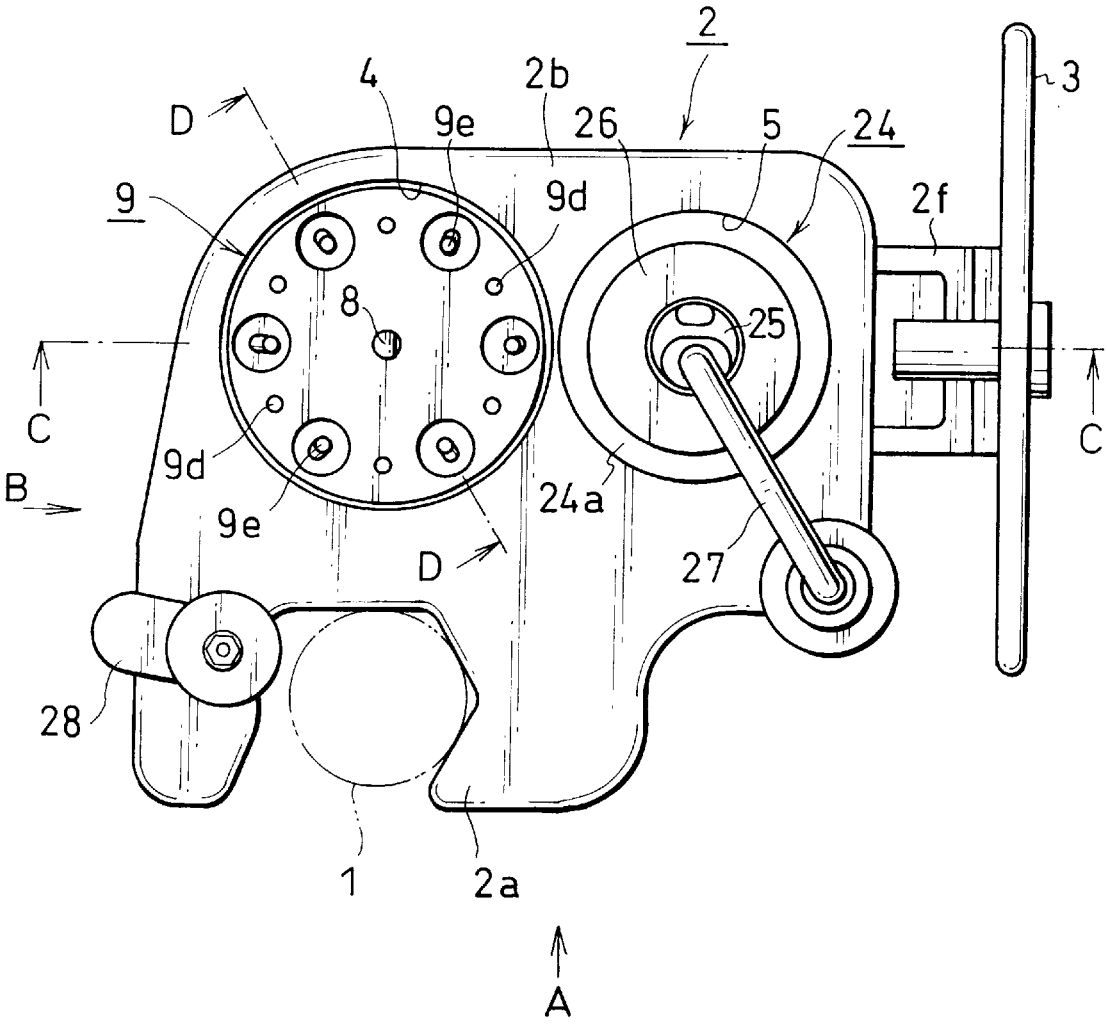
FIG. 1 is a plan view of the tensioner of this invention.
Figure 2:
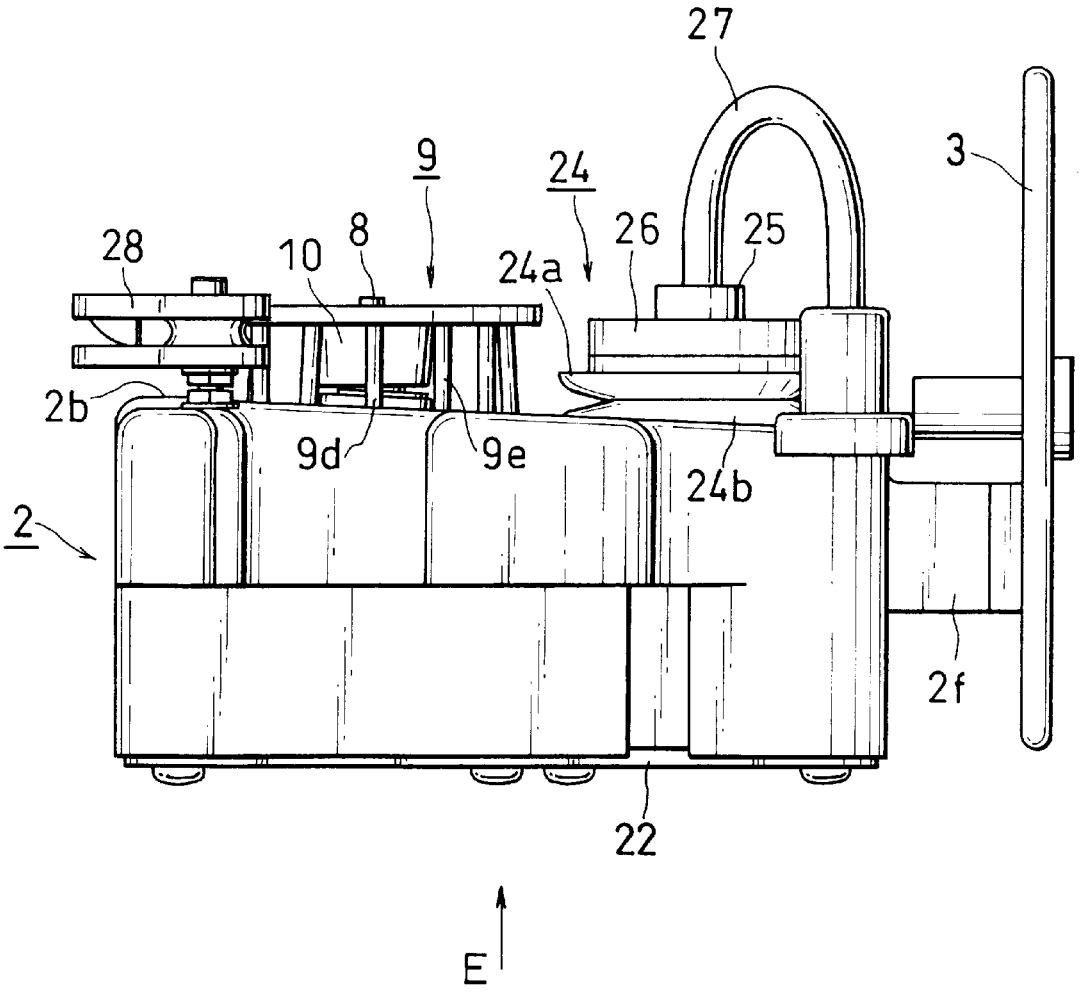
FIG. 2 is a side view of FIG. 1 along arrow A.
Figure 3:
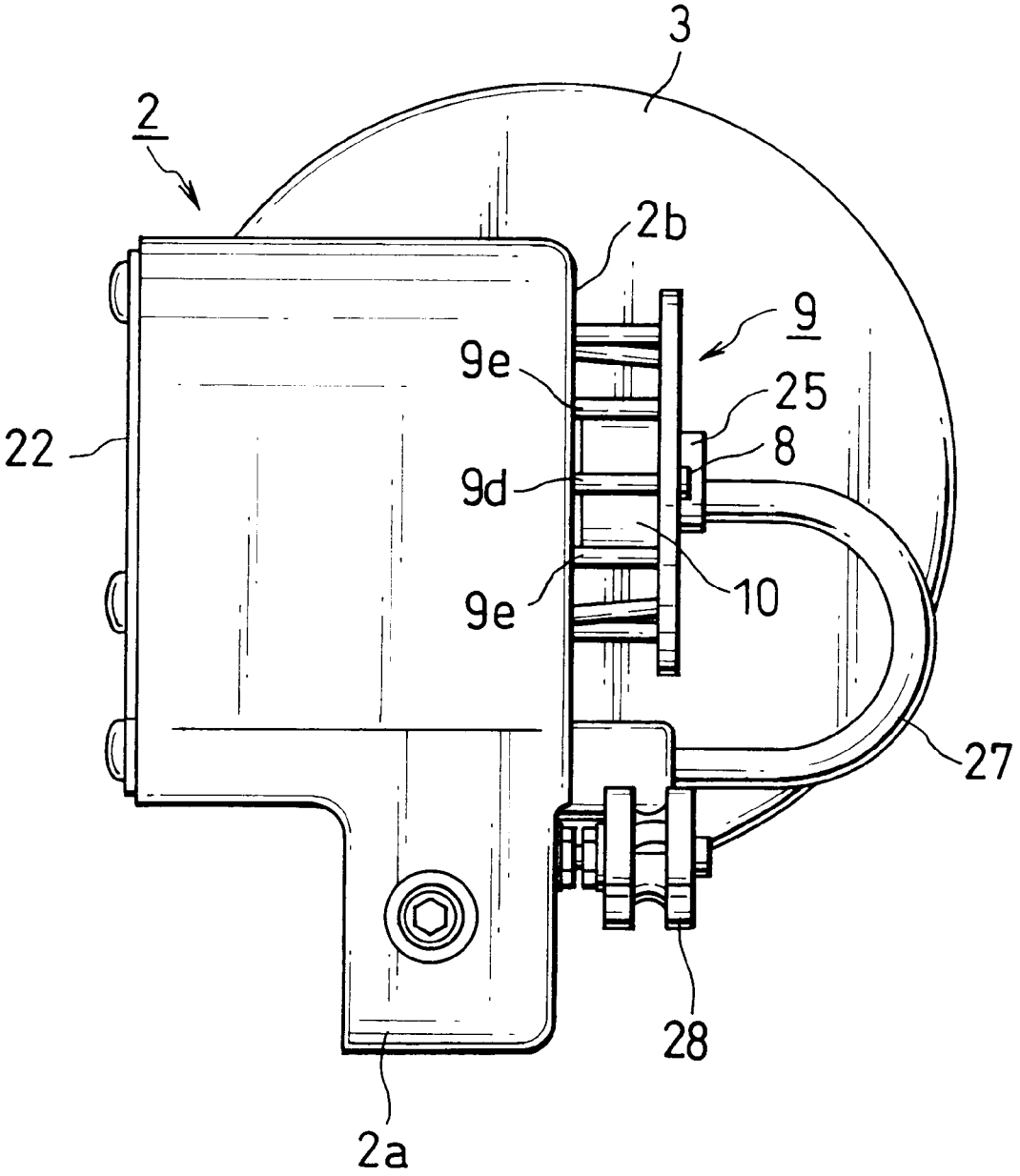
FIG. 3 is a side view of FIG. 1 along arrow B.
Figure 4:
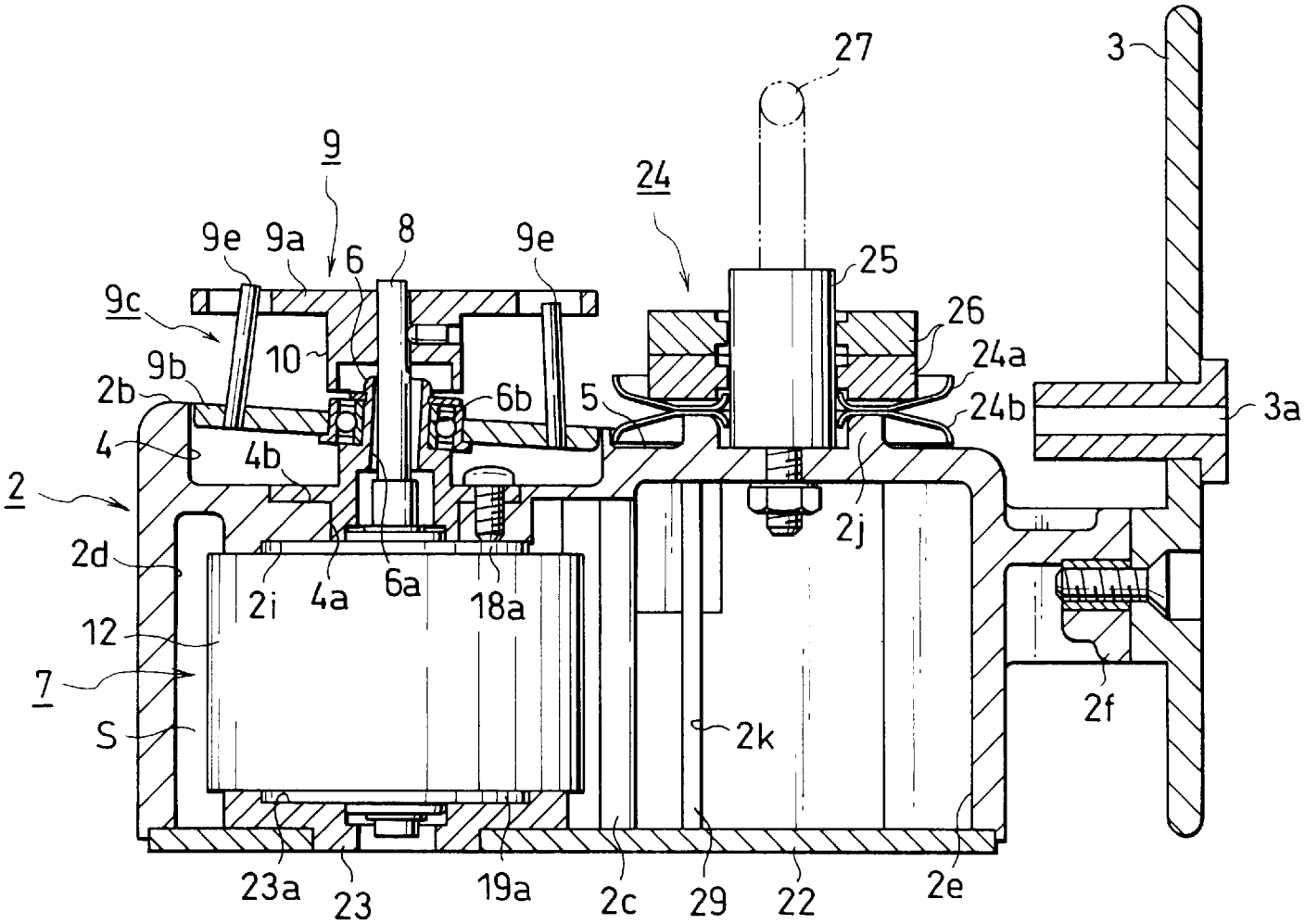
FIG. 4 is a sectional view along line C—C section of FIG. 1.
Figure 5:
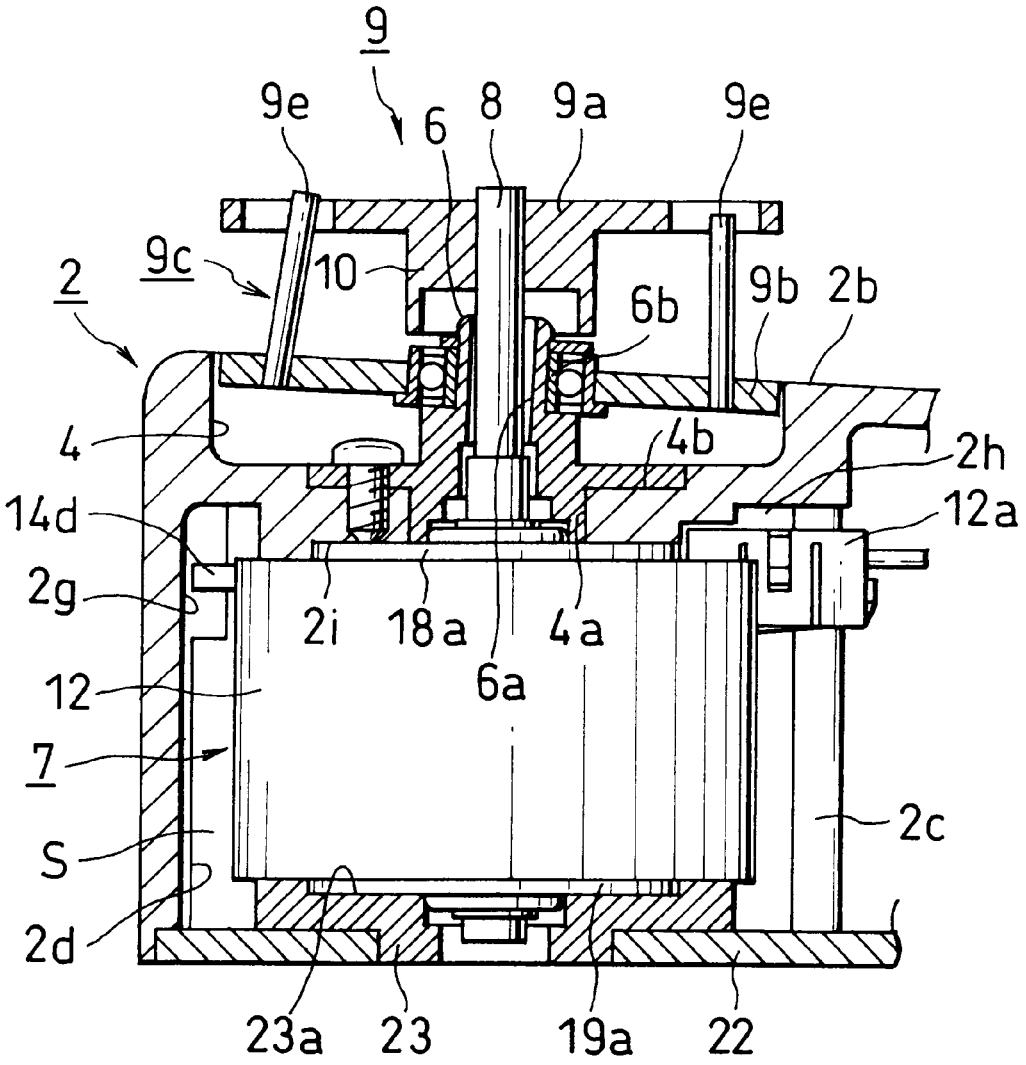
FIG. 5 is a sectional view along line D—D section of FIG. 1.
Figure 6:
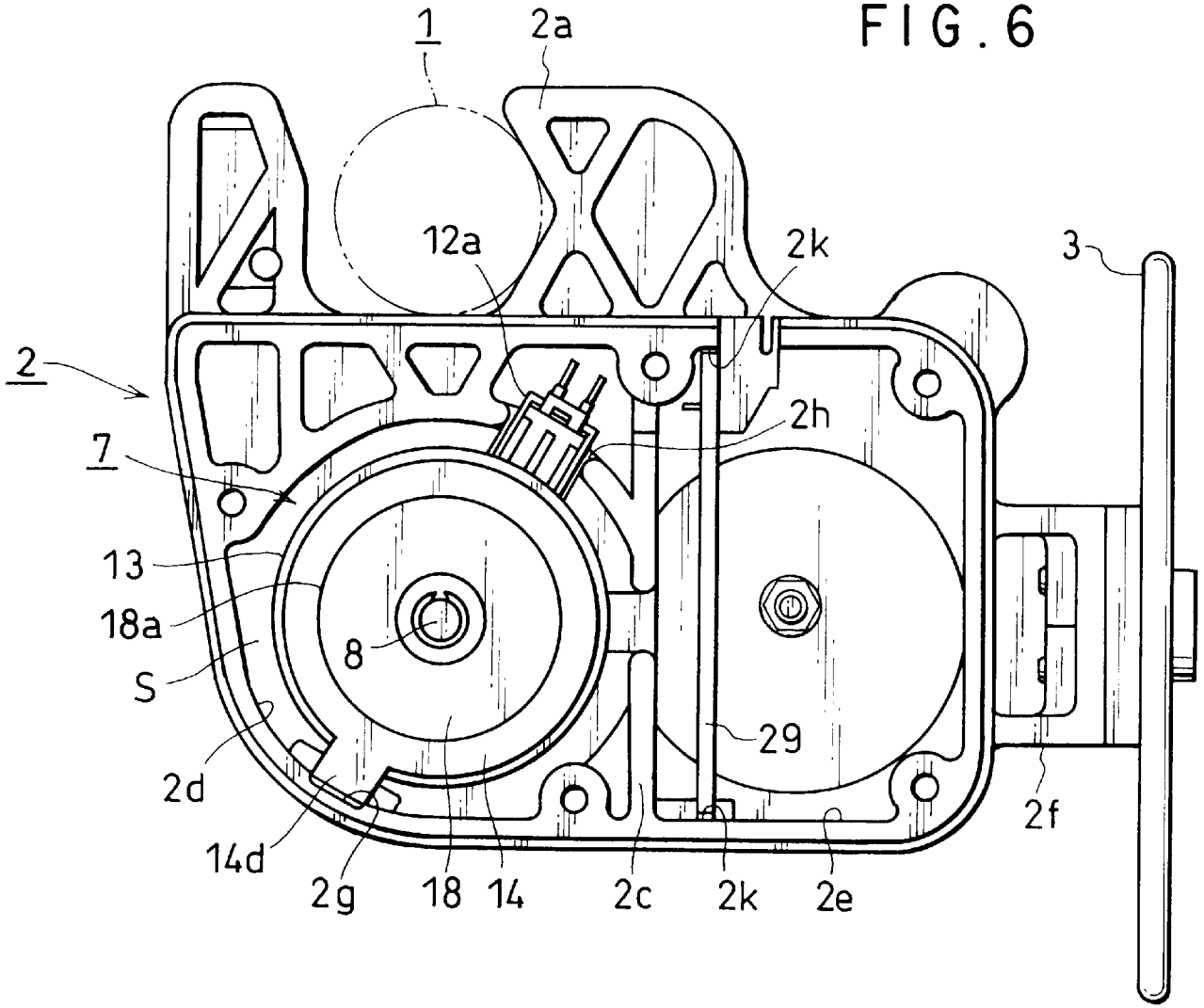
FIG. 6 is the side view of FIG. 2 along arrow E with the cover removed.
Figure 7:
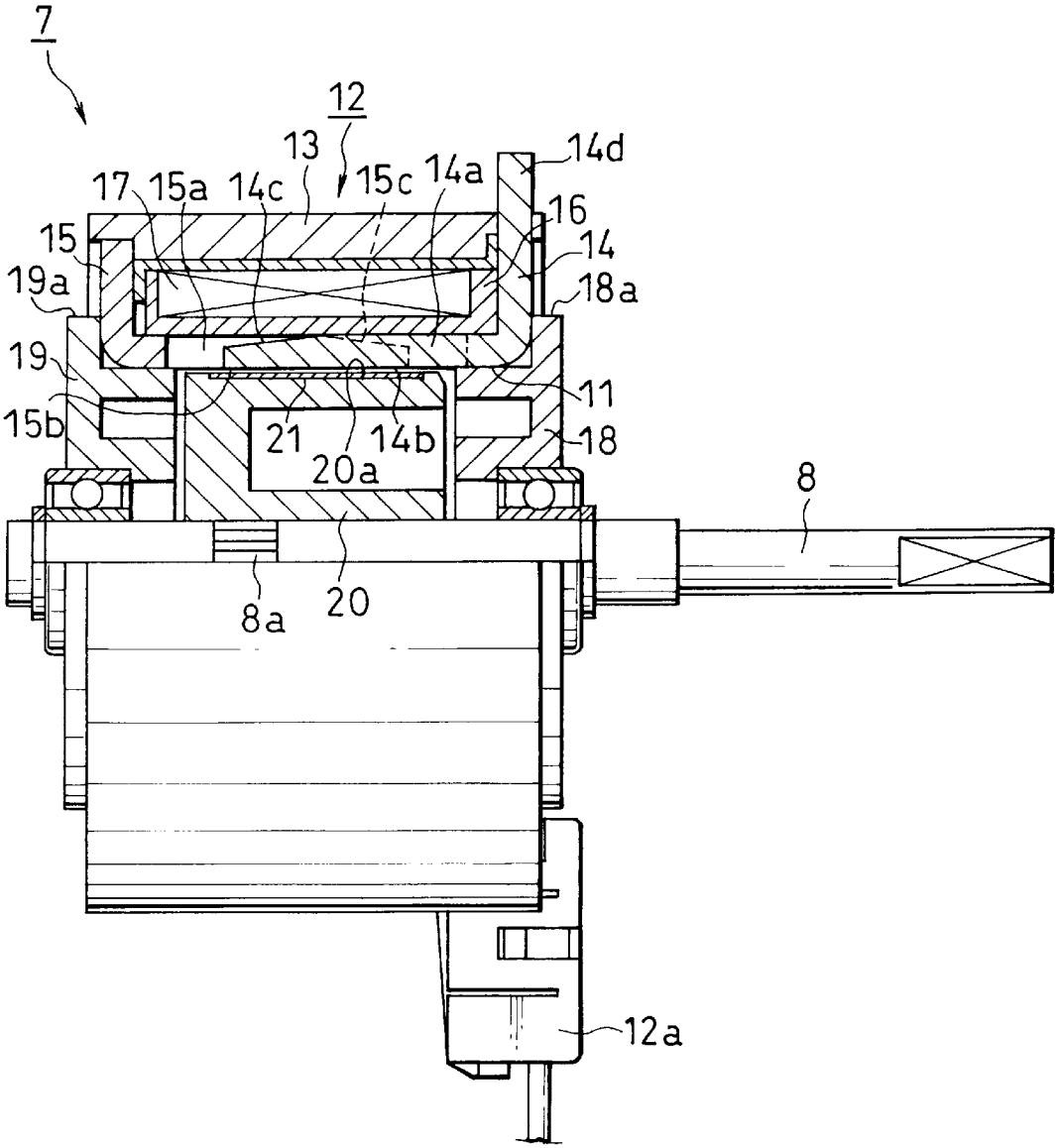
FIG. 7 is a side view of the brake device with its upper half in cross-section.

The tension device shown in FIGS. 1–7 as an embodiment of this invention is explained below. FIG. 1 is a plan view, FIG. 2 is a view of FIG. 1 along arrow A, FIG. 3 is a side view of FIG. 1 along arrow B, FIG. 4 is section C—C of FIG. 1, FIG. 5 is section D—D of FIG. 1, FIG. 6 is a side view of FIG. 2 along arrow E with the cover member removed, and FIG. 7 is a side view of the brake device with its upper half in cross-section.

The tension device shown in these figures is most suitable for a gale tenser of a warping machine. It has a bracket 2, in which a U-shaped attachment part 2*a*, fitted to attachment shaft 1, stands on the frame of the warping machine and fixed to attachment shaft 1 with a headless screw. This bracket 2 is made of antistatic resin and is box-shaped. It has an inclined surface on the side of yarn running surface 2*b*, which becomes its top side when it is attached to the warping machine. Number 1 (first) storage part 2*d* and number 2 (second) storage part 2*e* divided by bulkhead 2*c* are provided on the opposite side of the yarn running surface of bracket 2. In addition, guide fixing part 2*f* that projects from the side face, is provided on the side of the bottom inclined surface of inclined surfaces 2*b* of bracket 2.

Inlet guide 3 is attached to guide fixing part 2*f* by a threaded connection and inclined surface 2*b* of bracket 2 is so formed that it becomes gradually higher from the side of yarn path 3*a* of said inlet guide 3 (yarn feeding inlet). Annular number 2 (second) concave part 5, on the side of the bottom inclined surface and annular number 1 (first) concave part 4 on the side of the upper inclined surface are provided to the inclined surface 2*b* of bracket 2 on both sides of the center line of yarn path 3*a* of inlet guide 3. Annular step 4*b* is provided to the bottom of the number 1 (first) concave part 4 by forming the edge of center hole 4*a* into a concave shape. Tube member 6, made of synthetic resin, in which a cylindrical part, fitted to center hole 4*a* and a flange part fitted to step part 4*b* are formed, stands at the bottom center of number 1 concave part 4 by fixing the flange part onto the step part 4*b* by use of a screw. An insertion hole, 6*a*, the side of which to number 1 storage part 2*d* is coaxial with the number 1 concave part, cylindrical support part 6*b* (in detail, a cylindrical outer surface), which is eccentric to the center of rotary shaft 8 mentioned later, and number 1 concave part 4 which is tilted in the same angle as inclined surface 2*b* of bracket 2, are provided to tube member 6. Incidentally, tube member 6 can be made of antistatic resin or nonmagnetic metals, etc. Also, bracket 2 and tube member 6 can be integral instead of separate parts. The antistatic resin is a permanently antistatic resin of the acrylonitrile butadiene styrene resin (ABS resin) system and bracket 2, etc., in this embodiment are made of Toray K. K. Toyorac Barell (trademark).

Rotary shaft 8 of electromagnetic brake device 7 stored in number 1 (first) storage part 2*d* of bracket 2 is inserted into insertion hole 6*a* of tube member 6. Pulley 9, as the yarn advance guiding member integrally fixed by a headless screw, is installed onto the shaft end of rotary shaft 8 that projects from insertion hole 6*a*. Pulley 9 has number 1 (first) hub member 9*a* made of synthetic resin, the cylindrical boss part of which with cup-like cover 10 is fixed onto rotary shaft 8 and number 2 (second) hub member 9*b* made of synthetic resin, the round-plate-like boss part of which is supported coaxially and rotatably to support part 6*b* of tube member 6. The flange part of number 1 (first) hub member 9*a*, in a round-plate-like shape, is formed on the inside face that is at a right angle to the axial direction of rotary shaft 8. The inside face of the flange of number 2 (second) hub member 9*b*, in the shape of a round plate, is formed in the same plane as inclined surface 2*b* of bracket 2 at the opening of number 1 concave part 4.

Wrap-around part 9*c*, that connects the flanges of number 1 hub member 9*a* and number 2 hub member 9*b* is formed in pulley 9. That is, the pulley 9 in this embodiment has multiple rods 9*d* fixed to the flange of number 1 hub member 9*a* and inserted in the through-holes of the flange of number 2 hub member 9*b*, and multiple rods 9*e*, fixed to the flange of number 2 hub member 9*b* and inserted in the through holes in the flange of number 1 hub member 9*a*, are alternately placed at its circumferential positions of equal division. Each rod 9*d* is fixed to a flange, so that it is parallel to the center line of rotary shaft 8 and each rod 9*e* is fixed to a flange so that it tilts toward the center of rotary shaft 8. Furthermore, the yarn is wound helically from the side of the flange of number 2 hub member 9*b* to the side of the flange of number 1 hub member 9*a*, onto the wrap-around part 9*c* formed by rods 9*d* and 9*e* of such construction. The yarn runs cleanly and helically on wrap-around part 9*c*. Also, a set tension is applied to the yarn because rotary shaft 8 of electromagnetic brake device 7 is rotated by such running of the yarn.

Next, electromagnetic brake device 7, shown in FIG. 7, is explained. Field core 12 of electromagnetic brake device 7 has outer surface 18*a* of flange 18 formed concavely at the edge of center hole 4*a* that acts as a spigot joint by fitting to step 2*i* of number 1 storage part 2*d*, and outer surface 19*a* of flange member 19 that acts as a spigot joint by fitting to step 23*a* of core retention member 23, mentioned later, and it is stored in number 1 storage part 2*d* of bracket 2 with annular space S (see FIG. 4). This field core 12 has cylindrical number 1 yoke 13 and annular number 2 and 3 yokes 14, 15 with L-shaped cross-section. Electromagnetic coil 17 wound up on coil bobbin 16 is placed inside the annular space formed by the integration fitting of these yokes 13, 14 and 15. Multiple magnetic pole pieces 14*a* are formed in the cylindrical part of No. 2 yoke 14 at a circumferential interval. Magnetic pole pieces 14*a* are formed so that their inner faces 14*b* are in the circumferential arc surface and they are formed so that their outer faces 14*c* become lower toward their tip. The circumferential width of magnetic pole piece 14*a* narrows toward its tip. That is, the cross-sectional area of the said magnetic pole piece 14*a* decreases toward its tip. On the other hand, multiple magnetic pole pieces 15*a* at the cylindrical part of No. 3 yoke 15, too, have their outer faces 15*c* formed into an arc-like inner surface 15*b* and a tapered plane, and their cross-sectional area decreases toward their tip. These magnetic pole pieces 14*a*, 15*a* are meshed together alternatingly to form gaps in the circumferential direction and axial direction. Furthermore, the arc-like inner surfaces 14*b*, 15*b* of these multiple magnetic pole pieces 14*a*, 15*a* form the magnetic pole surfaces in which the N pole and S pole are formed alternatingly in the circumferential direction.

Flange members 18, 19 made of synthetic resin or aluminum are press-fitted for fixing from both sides at the arc-like bent parts of number 2 and 3 yokes 14, 15, in detail, at center hole 11 of the field core of such construction. The bearing is filled respectively to the inner faces of flange members 18, 19 end rotary shaft 8 is supported rotatably onto field core 12 via these flange members 18, 19 and the bearings. Incidentally, the snap ring in the stop groove of rotary shaft 8 prevents pulling off of the bearings and axial movement of rotary shaft 8 is restricted against field core 12. Rotary shaft 8 inside of field core 12 has boss member 20 made of synthetic resin or the non-magnetic metal installed on it. Boss member 20 is of a member with shaped cross-section and it is fixed integrally onto rotary shaft 8 by having its inner surface bite into convex/concave raised part 8*a* of rotary shaft 8. The side face in the axial direction does not cross the inside faces of flange members 18, 19 in the radial direction, and boss member 20 is placed between flange members 18, 19 without making contact. Hysteresis magnet 21 is fitted in annular groove 20*a* formed in the outer surface of boss member 20, and a radial gap is formed between the outer surface of the said hysteresis magnet 21 and the inner surfaces 14*b*, 15*b* of magnetic pole pieces 14*a*, 15*a* of field core 12. Hysteresis magnet 21 is made of rolled semihard magnetic material sheet formed into a cylindrical form and both of its ends are expanded to fit annular groove 20*a* of boss member 20. It is fixed onto boss member 20 by the elastic recovery force of this hysteresis magnet 21. Incidentally, hysteresis magnet 21, formed into a cylinder in advance, can also be press-fitted to annular groove 20*a* of boss member 20.

Electromagnetic brake device 7, of such construction, has its field core 12 stopped against rotation in number 1 storage part 2*d*, by fitting projection 14*d* formed in number 2 yoke 14 into cut-out groove 2*g* in the wall of number 1 storage part 2*d* of bracket 2 and by fitting terminal housing 12*a* of the terminal connecting electromagnetic coil 17 and a lead wire to separate cut-out groove 2*h* in the wall. Further, field core 12 is fixed in the axial direction inside number 1 storage part 2*d* by fitting outer surface 18*a* of flange member 18 on the side of number 2 yoke 14 to annular step 2*i* of number 1 storage part 2*d* and by fitting outer surface 19*a* of flange member 19 on the side of No. 3 yoke 15 to annular step 23*a* of core retention member 23, which is fixed to cover 22 made of antistatic resin that covers the opening of the number 1 storage part 2*d* and the number 2 storage part 2*e*. Incidentally, core retention member 23 is made of nonmagnetic metal with good thermal conductivity such as aluminum and it is contacted with the side face of No. 3 yoke 15 of electromagnetic brake device 7 and cover 22 is exposed to the outside. Cover 22 and core retention member 23 can be formed integrally with the said nonmagnetic metal instead of being separate parts.

Next, tenser 24 installed at number 2 concave part 5 of bracket 2 is explained. Tenser 24 has upper tenser disc 24*a* and lower tenser disc 24*b*, made of synthetic resin or thin steel sheet, formed in bulged-out dish form and weight 26. These tenser discs 24*a*, 24*b* are freely fitted into cylindrical support shaft 25 made of synthetic resin, which is fixed at the bottom center of number 2 concave part 5, and they are placed on annular projection 2*j* that projects from the opening of the number 2 concave part 5, integral with the bottom of number 2 concave part 5 so that the bulged-out outer surface of the lower tenser disc 24*b* fits in number 2 concave part 5. Multiple weights 26 shaped like round plates, placed on tenser discs 24*a*, 24*b*, are freely fit to support shaft 25. An eccentric insertion hole is formed at the tip of support shaft 25 and one end of tenser holder 27, bent, U-shaped, is inserted in this insertion hole. The other end of tenser holder 27 is fixed to the non-yarn path part of bracket 2 and over tenser 24. That is, tenser 24, placed in the yarn path, is guided by tenser holder 27 and is retreated to the non-yarn path part of bracket 2.

Incidentally part 28, shown in FIGS. 1 and 2, is a roller guide that acts as an outlet guide and part 29 in FIGS. 4 and 6 is a control board of which both ends are inserted in a pair of insertion grooves 2K in the wall of number 2 storage 2*e*.

In the tension device of such construction, the yarn path is formed so that the yarn is led from inlet guide 3, past tenser 24, through pulley 9 to outlet guide 28. Supplemental tension due to tenser 24 and main tension due to electromagnetic brake device 7 are applied to the yarn because the magnetic flux of electromagnetic coil 17 flows in hysteresis magnet 21 and rotary shaft 8 and pulley 9 are braked by the delay in polarity change of hysteresis magnet 21 when the yarn is allowed to run while the electromagnetic brake device 7 is activated with its electric magnetic coil 17 being energized. When the yarn is stopped and electromagnetic coil 17 de-energized, the brake force on rotary shaft 8 and pulley 9 rotated by the running of yarn, disappears. The yarn can slacken and come off from pulley 9 due to the inertial rotation of pulley 9 when the yarn stops, but in the tension device explained in the embodiment, the surface of number 2 hub member 9*b* of pulley 9, which is fitted to number 1 concave part 4 and opposes number 1 hub member 9*a*, is put in the same plane as inclined surface 2*b* of bracket 2, at the opening of number 1 concave part 4, so that the yarn is not wound up on tube member 6 and the yarn is allowed to rerun without the problem of being cut.

In the tension device explained as an embodiment, lower tension disc 24*b* of tenser 24 is fitted to number 2 concave part 5 and its bulged-out outer edge is kept from exposure to the outside of inclined surface 2*b* of bracket 2, so that the yarn is allowed to rerun without the problem of being pinched and cut between the outer edge of lower tenser disc 24*b* and inclined surface 2*b* of bracket 2.

Figure 8:
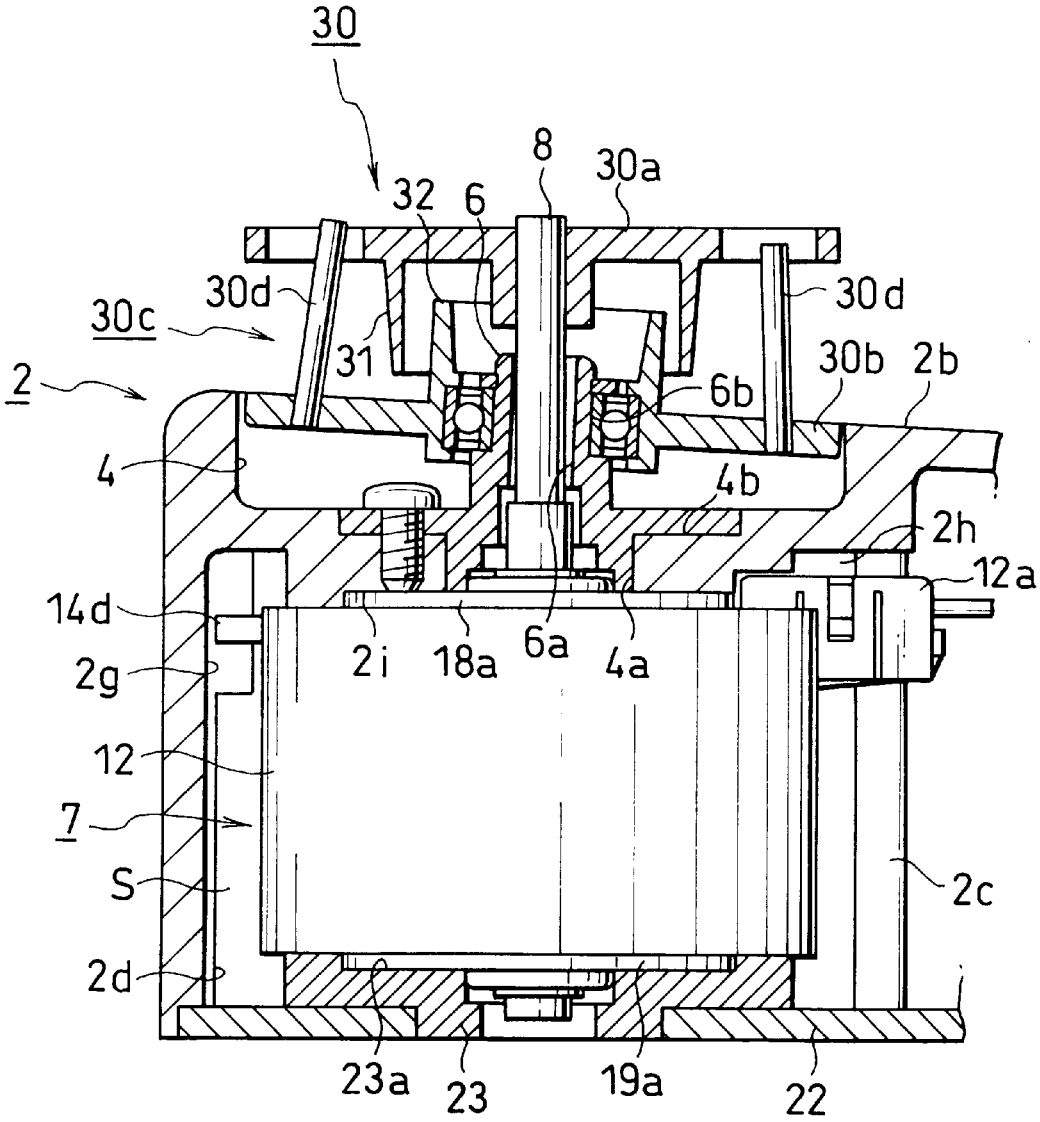
FIG. 8 is a cross-section of the tensioner of another embodiment.

Next, another embodiment of this invention is explained. FIG. 8 is a cross-section of a tension device that corresponds to FIG. 5. Incidentally, construction of the pulley that acts as advance guiding member only, is different in this embodiment from the previous one, therefore, the pulley and its peripheral construction are explained below. Pulley 30 attached to the shaft end of rotary shaft 8 projecting from insertion hole 6*a* of tube member 6 has number 1 hub member 30*a* made of synthetic resin in which the cylindrical boss part with cup-like number 1 cover 31, fixed to rotary shaft 8 and number 2 hub member 30*b* in which cup-like number 2 cover 32, freely fitted inside cover 31, is provided to the cylindrical boss part and which is supported rotatably and coaxially via the bearing on support part 6*b* of tube member 6. The flange in the round-plate shape of number 1 hub member 30*a* is formed on the inner surface that is at a right angle to the axial direction of rotary shaft 8. The round plate-like flange of number 2 hub member 30*b* has its inner face opposing the said inner face of number 1 hub member 30*a*, formed in the same plane as the inclined surface 2*b* of bracket 2, at the opening of number 1 concave part 4. Incidentally, the outer ring of the bearing is press-fit and fixed integrally to the inner face of the boss part of number 2 hub member 30*b* and number 2 hub member 30*b* is supported rotatably on tube member 6 by fitting the inner ring of the bearing to tube member 6 and stopping it from being pulled off by the snap ring. Number 2 hub member 30*a* is fixed to rotary shaft 8 by a headless screw, not shown.

Pulley 30 has a wrap-around part 30*c* that connects the flanges of number 1 hub member 30*a* and the number 2 hub member 30*b*. That is, in this pulley 30, multiple rods (not shown) (see rods 9*d* in FIGS. 2 and 3) inserted in through holes in the flanges of number 2 hub member 30*b* and fixed to the flange of number 1 hub member 30*a* and multiple rods 30*d*, which are fixed to the flange of the number 2 hub member 30*b* and inserted in the through holes in the flange of the number 1 hub member 30*a* are placed alternatingly in the circumferential direction. Each rod fixed to the number 1 hub member 30*a* is fixed to the flange so that it is parallel to the center line of the rotary shaft and rod 30*d*, fixed to the number 2 hub member 30*b*, is fixed to the flange so that its tip tilts toward the center of the rotary shaft 8. Yarn is wound up helically and cleanly onto the wrap-around part 30*c*, formed with rods, not shown, and rods 30*d* from the side of the flange of the number 2 hub member 30*b* to the flange of the number 1 hub member 30*a*. A set tension is applied to the yarn because rotary shaft 8 of electromagnetic brake device 7 is rotated by such running of the yarn.

In the tension device with such pulley 30, the yarn path is formed from inlet guide 3 through tenser 24 and pulley 30 to outlet guide 28. When electromagnetic brake device 7, activated with electromagnetic coil 17, is energized, and the yarn is allowed to run, the magnetic flux of electromagnetic coil 17 flows in hysteresis magnet 21 and rotary shaft 8 and pulley 30 are braked by the delay in polarity change in hysteresis magnet 21 so that supplemental tension due to tenser 24 and the main tension due to electromagnetic brake device 7 are applied to the yarn.

The embodiment mode of this invention was explained above except that this tensioner can use a brake device other than the electromagnetic brake device. For example, an eddy-current brake using a conductor member of aluminum or electric copper instead of an hysteresis magnet, powder brake using magnetic powder in the path of the magnetic flux and a magnetic member instead of a hysteresis magnet, etc. Multiple rods are used in the wrap-around part of the pulley, but it can be another advance guiding member. For example, a pulley with a pair of hub members with integrally formed rods in its flange or pulley, on which the yarn runs helically, can be used. In addition, the tensioner explained as in the above embodiment mode, has supplemental tension. According to the weight of the weight added to the yarn pinched between opposing working surfaces of tenser discs, but the tension according to the spring force of the coil spring can be added to the yarn by using the tenser in which a coil spring is placed between the adjuster ring screwed on the tenser holder and upper tenser disc. When such supplemental tenser is not needed, it can be a tensioner without a tenser.

As explained above, the tensioner of the invention has a cover that covers the tip of the tubular member provided in the boss part of the advance guiding member, so that the entrance of the yarn chip, etc., into the insertion hole of the tubular member is prevented and a set tension can be added to the yarn for a long time.

The tension device of the invention has an advance guiding member having number 2 hub member, which is fitted to the concave part in the inclined surface of the bracket and the surface of which that is opposite to the number 1 hub member and in the same plane as the inclined surface of the bracket at the opening of the concave part provided to it, so that the yarn slackens due to the inertial rotation of the advance guiding member, comes off from the inclined surface of the bracket and is wound up on the wrap-around part of the advance guiding member when the yarn is allowed to run again. Therefore, cutting of the yarn, caused by yarn slackening due to inertial rotation of the advance guiding member, is prevented in this tension device.

In the tension device, a support shaft is standing at the bottom center of the number 2 concave part on the inclined surface of the bracket and lower tenser disc of the tenser, the bulged-out side of which is fitted to number 2 concave part, is freely fit to support the shaft, so that the yarn slackens due to mutual rotation of advance guiding member and comes off to the side of the inclined surface of the bracket, which is not pinched between the bulged-out outer edge of the lower tenser disc and the inclined surface of the bracket, so that the yarn can be spun across the tenser and the advance guiding member, when the yarn is allowed to rerun. Therefore, a tension device that prevents cutting of the yarn due to a slack in the yarn, caused by the inertial rotation of the advance guiding member, can be offered.

The tensioner has covers for the boss parts of the number 1 hub member that composes the advance guiding member and the number 2 hub member and labyrinth seal is provided around the rotary shaft by freely fitting such covers so that the entrance of the yarn chip, etc., into the insertion hole of the tubular member is prevented and a set tension can be added to a yarn for a long time.

The tensioner has a cover that covers the tip of the tubular member provided to the boss part of the number 1 hub member so that the yarn chip, etc., are prevented from entrance into the insertion hole of the tubular member and a set tension can be added to the yarn for a long time. Also, the surface of the number 2 hub member opposing the number 1 hub member of the advance guilding member is placed in the same plane as an inclined surface of the bracket so that the yarn would not wind up on the tubular member and be cut, even if the yarn slackens and curves off from the advance guiding member due to the inertial rotation of the advance guiding member.

In the tension device, a tenser is retreated from the yarn path by being guided by a tenser holder so that the general purpose properties of the tension device are improved. In addition, tension adjustment is simple, through changing of the number of weights according to the type of yarn because supplemental tension applied to the yarn is adjusted in steps by placement of the weights on the tenser.

The tensioner has covers at the boss parts of the number 1 hub member and the number 2 hub member that compose the advance guiding member and free-fit them to form a labyrinth seal around the rotary shaft, therefore, the entrance of yarn chips into the insertion hole of the tubular member is firmly prevented.

What is claimed is:

1. A tension device for winding yarn, comprising:

a bracket (2) having a side for a running face for filaments, said bracket having a sloped face (2*b*) inclined at a predetermined angle with an annular recessed portion (4) formed in said sloped face, and, said bracket having an accommodating portion (2*d*) formed in said recessed portion (4) on the opposite side of said running face;

a braking device (7) accommodated in said accommodating portion (2*d*), said braking device having a rotary shaft (8) protruding from the center of the bottom of said recessed portion (4):

a tubular member (6) erected on the center of the bottom of said recessed portion (4), said tubular member including a through hole (6*a*) for said rotary shaft (8) and a cylindrical support portion (6*b*) made eccentric with respect to the center of said rotary shaft and inclined at the same angle as that of said sloped face; and a forward guide member (9) on said running face side of said bracket, said guide member including a first hub member (9*a*) mounted on the axial end of said rotary shaft protruding from said tubular member (6), a second hub member (9*b*) fitted in said recessed portion (4), having a face, as confronting said first hub member, flush with said sloped face at the opening of said recessed portion, and supported rotatably by said support portion; and a winding portion (9*c*) joining said hub members (9*a*, 9*b*).

2. A tension device according to claim 1, wherein the winding portion (9*c*) of said forward guide member (9) includes in the circumferential direction a plurality of rods (9*d*) fixed on the flange portion of said first hub member and inserted into the through holes of the flange portion of said second hub member alternating with a plurality of rods (9*e*) fixed on the flange portion of said second hub member and inserted into through holes of the flange portion of said first hub member.

3. A tension device according to claim 2, wherein said first hub member (9*a*) includes a first cover member (10) for covering the leading end portion of said tubular member.

4. A tension device according to claim 3, wherein said second hub member (9*b*) includes a second cover portion to be loosely fitted in said first cover portion.

5. A tension device for winding yarn, comprising:

a bracket (2) having a side for a running face for filaments, said bracket having a sloped face (2*b*) inclined at a predetermined angle with a first annular recessed portion (4) formed in the upper slope side of said sloped face and a second annular recessed portion (5) formed in the lower slope sides of the same, and, said bracket having an accommodating portion (2*d*) formed in said first recessed portion (4) on the opposite side of said running face;

a braking device (7) accommodated in said accommodating portion (2*d*) and having a rotary shaft (8) protruding from the center of the bottom of said first recessed portion (4);

a tubular member (6) erected on the center of the bottom of said first recessed portion (4), said tubular member including a through hole (6*a*) for said rotary shaft (8) and a cylindrical support portion (6*b*) made eccentric with respect to the center of said rotary shaft and inclined at the same angle as that of said sloped face;

a forward guide member (9) on said running face side of said bracket, said guide member including a first hub member (9*a*) mounted on the axial end of said rotary shaft protruding from said tubular member (6), a second hub member (9*b*) fitted in said first recessed portion (4), having a face, as confronting said first hub member, flush with said sloped face at the opening of said first recessed portion, and supported rotatably by said support portion, and a winding portion (9*c*) joining said hub members (9*a*, 9*b*);

a support shaft (25) extending from the center of the bottom of said second recessed portion; and;

a tenser on said running face side of said bracket, said tenser including a lower tenser disc (24*b*) of a bulging disc shape fitted loosely on said support shaft and fitted at its bulging side in said second recessed portion, an upper tenser disc (24*a*) of a bulging disc shape fitted loosely on said support shaft and placed on said lower tenser disc; and a push member (26) for pushing said upper tenser disc toward said lower tenser disc.

6. A tension device according to claim 5, wherein the winding portion (9*c*)of said forward guide member (9) includes in the circumferential direction a plurality of rods (9*b*) fixed on the flange portion of said first hub member and inserted into through holes of the flange portion of said second hub member alternating with a plurality of rods (9*e*) fixed on the flange portion of said second hub member and inserted into the through holes of the flange portion of said first hub member.

7. A tension device according to claim 6, wherein said first hub member (9*a*) includes a first cover member (10) for covering the leading end portion of said tubular member.

8. A tension device according to claim 7, wherein said second hub member (9*b*) includes a second cover portion to be loosely fitted in said first cover portion.

9. A tension device according to claim 5, further comprising:

a tenser holder (27) joined at its one end to said support shaft (25) and extended at its other end to a non-guide portion of said bracket across said tenser, so that said tenser is retracted from the yarn path while being guided by said tenser holder.

* * * * *